US005240208A

United States Patent [19]

Hoover

[11] Patent Number: 5,240,208

[45] Date of Patent: Aug. 31, 1993

[54] TERMINAL BLOCK PANEL MOUNT

[75] Inventor: James M. Hoover, Galloway, Ohio

[73] Assignee: Jemtec Electronics Corporation, Columbus, Ohio

[21] Appl. No.: 901,377

[22] Filed: Jun. 19, 1992

[51] Int. Cl.[5] ..... G12B 9/00

[52] U.S. Cl. ..... 248/27.1; 220/4.02

[58] Field of Search ..... 248/27.1, 27.3, 906; 220/4.02

[56] References Cited

U.S. PATENT DOCUMENTS

| | | | |
|---|---|---|---|
| 1,536,906 | 9/1922 | Miller . | |
| 3,793,563 | 2/1974 | Brefka | 248/27.3 X |
| 3,806,721 | 4/1974 | Murphy, Jr. . | |
| 4,340,795 | 7/1982 | Arthur | 248/27.3 X |
| 4,939,406 | 7/1990 | Jeschonneck et al. | 248/27.1 X |
| 4,988,308 | 1/1991 | Toedtman | 248/27.3 X |

*Primary Examiner*—Ramon O. Ramirez
*Attorney, Agent, or Firm*—Frank H. Foster

[57] ABSTRACT

Structural formations for mounting an electrical terminal block in an aperture of a panel. A groove is formed on a longitudinal side of a rectangular terminal block. A shoulder with a surface facing toward the panel is formed on the opposite longitudinal side of the terminal block. Coplanar shoulders facing the same direction as the longitudinal shoulder are formed on the ends of the terminal block. The groove has greater width than the thickness of the panel, allowing for the panel to be angled with respect to the groove during insertion. The panel has an aperture with edges that contact the terminal block at all three coplanar shoulders, and the fourth edge contacts the oppositely facing surface of the groove.

12 Claims, 4 Drawing Sheets

TERMINAL BLOCK PANEL MOUNT

TECHNICAL FIELD

This invention relates to the field of supports for mounting an object in a panel, and more specifically to mounting an electrical terminal block in a housing panel.

BACKGROUND ART

When mounting an object in a flat, sheet-like panel, it is desirable that the mounting structure provide maximum support of the object by the panel so that the object is held firmly in a stable position. Desirably the mounting of the object in the panel can be accomplished simply and quickly requiring a minimum of manipulation and the fewest number of parts. The minimization of parts and labor reduces manufacturing costs.

Conventionally, objects such as electrical fixtures are placed over an aperture on a panel, so that the edges of the fixture overlap the aperture on all sides of the aperture and on one side of the panel. Then fasteners, such as screws, are installed at each overlapping edge. In this way the fixture is rigidly fastened to the panel, while allowing access to either side of the fixture through the aperture. If the panel is mounted to an enclosure, additional fasteners are used to accomplish that mounting.

A large number of fasteners were typically required to attach objects to panels using the above method, which made the number of people, quantity of parts and amount of time necessary for commercial production too high. These drawbacks led to the use of supporting flanges and grooves to support an object in a panel. However, even with these supports, there is still the necessity for too many fasteners and too many manipulative steps to get a mount which is both structurally effective and inexpensive.

Additional ways of simplifying insertion and mounting of an object into a panel using fewer fasteners and utilizing flanges have been presented by Miller in U.S. Pat. No. 1,536,906 and Murphy, Jr. in U.S. Pat. No. 3,806,721.

Miller shows a mount for attaching a soap dish to a sink panel. The mount comprises a flange extending around the entire front face of the soap dish. A small lip or ear at the top of the soap dish, spaced rearwardly from the flange, forms a short groove between the ear and the flange. The soap dish is placed in an aperture in the panel, with the top edge of the panel seated in the groove and the flange seating against the outer surface of the panel. Screws are threaded through the ear and the bottom of the flange. As described above, these screws increase the time and personnel necessary for installation, as well as requiring access from both sides of the panel for installation.

Murphy, Jr. shows a light bulb mount that is inserted into the panel of an automobile. While using a minimum of fasteners, Murphy's mount provides limited support. For example, at the top of the mounted object, there is no support by the edges of the aperture in the panel from the rear side of the panel. This leaves the mounted object unsupported from a rearward force, except for the rigidity provided by the screw at the lower side of the aperture. Depending on the rigidity of the mounted object and the strength of the fastener, the mounted object may be bent or otherwise displaced from the aperture due to forces applied at selected locations.

It is desirable that mounts prevent debris, in the form of solid particles or liquid, from passing through the aperture between its boundaries and the mounted object or from collecting in the mounted object. For example, in an electrical panel mounting, it is beneficial for the mount to prevent dust, hair and other debris from passing between the mounted object and the panel or other body on which the object is mounted. It is also desirable that a mount prevent insertion of a rigid object, such as a wire or pin, through the aperture adjacent the object mounted in the aperture.

Therefore, the need exists for a means for mounting an object on a panel in which the means firmly supports the object in a position, requires little effort to install and has the least number of auxiliary fasteners to simplify mounting and reduce expense. The mount should also prevent the passage of debris and other intrusive objects between the mounted object and the panel on which the object is mounted.

BRIEF DISCLOSURE OF INVENTION

The invention is an improved mount for mounting a polygonal object in an aperture formed in a panel having two surfaces. The mount comprises a primary shoulder formed on one side of the mounted object, the shoulder having a surface facing and seating against a first surface of the panel. The mount further comprises secondary shoulders formed on at least two other sides of the mounted object, each shoulder having a surface facing and seating against a second surface of the panel. The planes of the primary shoulder and the secondary shoulders are separated by approximately the thickness of the panel. The mount also includes a fastener for attaching one of the secondary shoulders to the panel.

Figure 1:
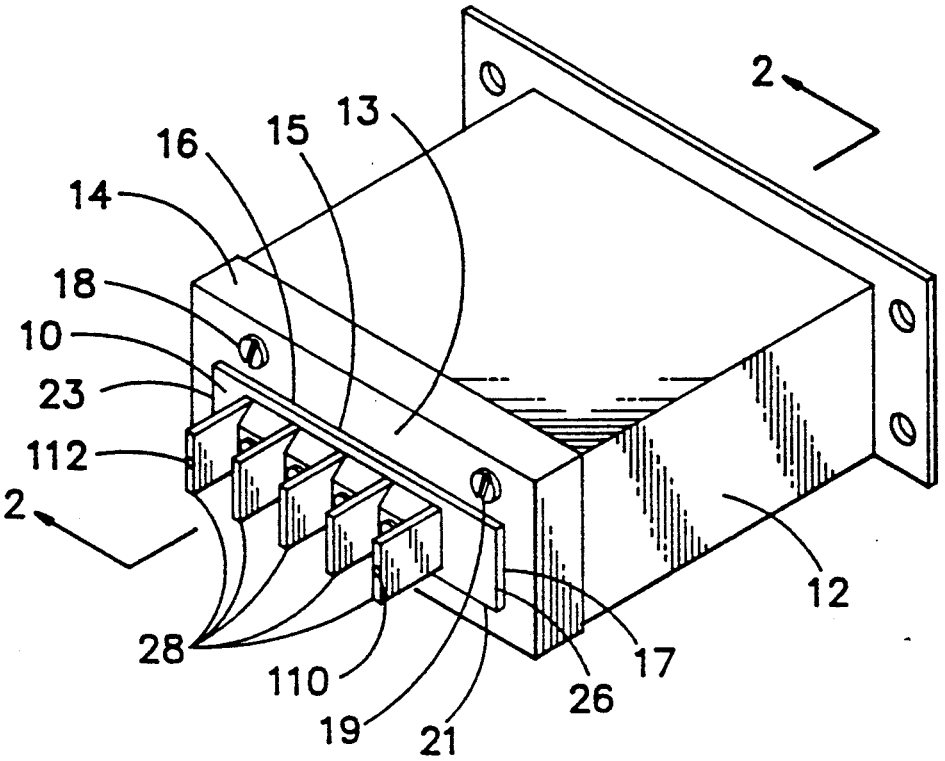
FIG. 1 is a view in perspective illustrating the preferred embodiment.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The preferred embodiment of the present invention is illustrated in FIG. 1 and shows a terminal block 10 mounted to a cabinet 12 having a lid 14. The cabinet 12 is a sheet metal box having a floor and four sides creating a hollow interior. The lid 14 is a rectangular, pan shaped panel having a large top panel 13 and four small sides, all made of sheet metal. The lid 14 has an aperture 16 formed in its top panel 13, through which a portion of the terminal block 10 protrudes from the interior of the cabinet 12. The lid 14 has edges 15, 17, 21 and 23 which define the aperture 16. Screws 18 and 19 extend through holes formed in the top panel 13 of the lid 14 and through holes formed in a portion of the terminal block 10, which is not visible in FIG. 1. The screws 18 and 19 are then threaded into a part of the cabinet 12. Holes 110 and 112 are located on the tops of terminal protecting end fins 28 into which screws can be inserted for holding down a rectangular protective panel over the ends of the fins 28.

Figure 2:
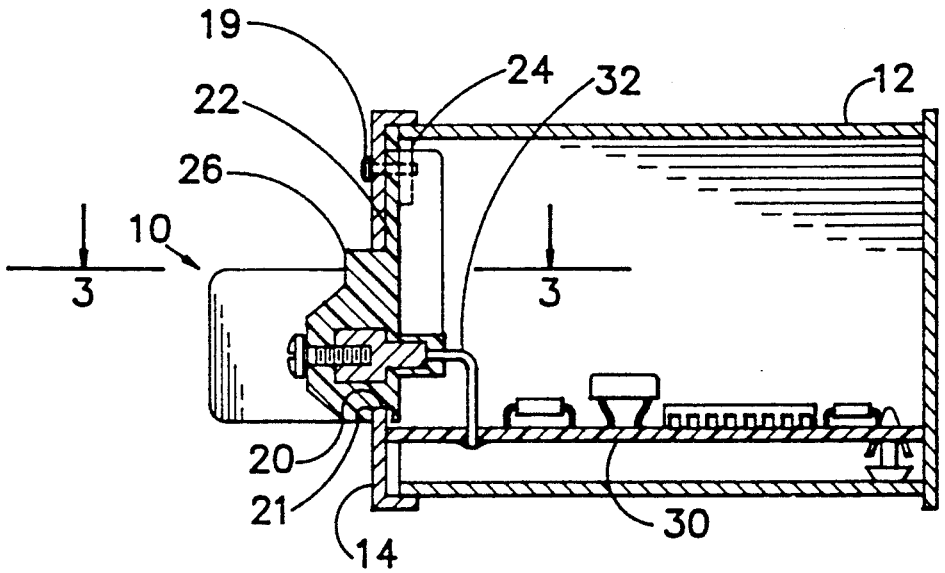
FIG. 2 is a side view in section illustrating the preferred embodiment.

FIG. 2 is a view in section along the line 2—2 of FIG. 1. FIG. 2 illustrates some elements of the preferred embodiment for mounting the terminal block 10 to the lid 14 and the cabinet 12. A groove 20 formed on the lower side of the terminal block 10 as shown in FIG. 2, extends along that longitudinal side of the terminal block 10. When the lid 14 is in its preferred, assembled position, the edge 21 of the lid 14 is seated within the groove 20.

On the opposite side of the terminal block 10 from the groove 20, a platform 22 extends laterally outward from and parallel to the terminal block 10. The platform 22 is placed between the rightmost surface of the lid 14 and a pair of tabs 24 and 25, only one of which is visible in FIG. 2. The tabs 24 and 25 are rectangular ears formed as part of the sidewalls of the cabinet 12, that are bent over to be generally perpendicular to the walls of the cabinet 12. These tabs 24 and 25 are then threaded to fit the screws 18 and 19 or self tapping screws are used. The platform 22 has a pair of holes formed through it, through which the screws 18 and 19 project to be threaded into the tabs 24 and 25.

A rim 26 is formed on the terminal block 10 creating a protruding, outer, peripheral ledge against which the edges 15, 17 and 23 of the aperture 16 butt. The fourth edge 21 is within the groove 20, just beneath and inward of the fourth side of the rim 26.

The terminal block 10 is attached to a printed circuit board 30 by a plurality of bent wire conductors forming pins 32 which extend from rigid connection with the terminal block 10 and electrical connection to its terminal screws to a soldered connection with the circuit board 30.

Figure 3:
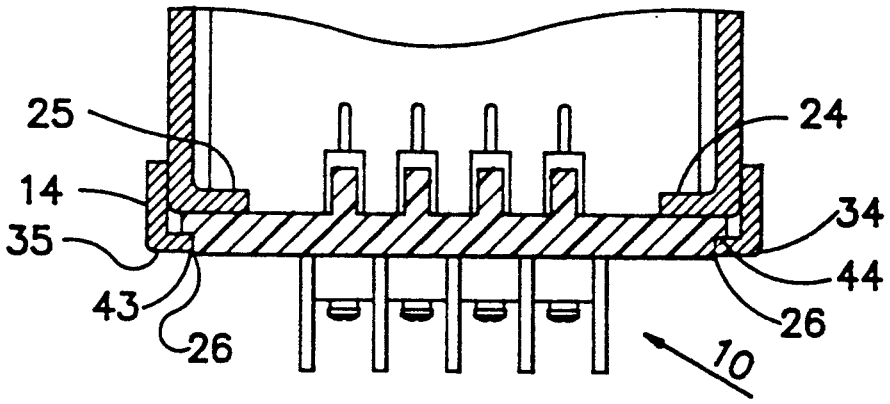
FIG. 3 is a top view in section illustrating the preferred embodiment.

The embodiment shown in FIG. 3 is the same device shown in FIGS. 1 and 2, but is viewed in section along the line 3—3 of FIG. 2 to illustrate other elements of the mounting structure. A pair of secondary end shoulders 34 and 35 are formed along the two short sides of the rectangular terminal block 10 just outward of the rim 26. These secondary end shoulders 34 and 35 contact a surface of the lid 14. The contact between the secondary end shoulders 34 and 35 and the surface of the lid 14 at the short sides of the aperture 16 will be seen to be significant in the support of the terminal block 10 in its mounted position. FIG. 3 also illustrates both tabs 24 and 25, which were not both visible in FIGS. 1 and 2.

Figure 4:
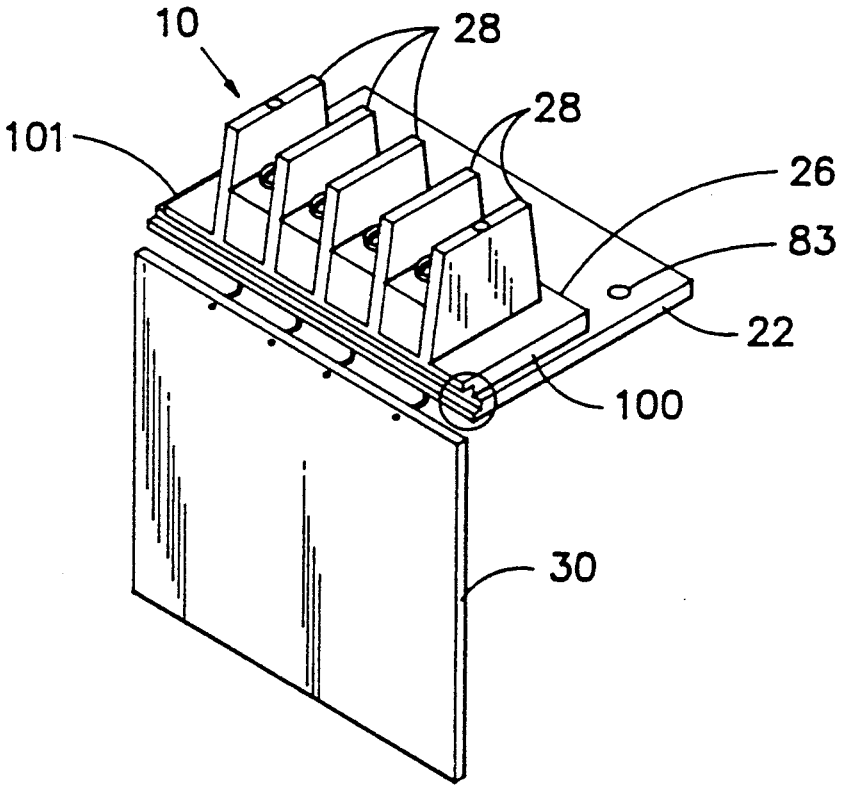
FIG. 4 is a view in perspective illustrating a typical terminal block and computer board.

FIG. 4 shows the terminal block 10 and the attached circuit board 30 in perspective to illustrate the formations around the periphery of the terminal block 10.

Figure 5:
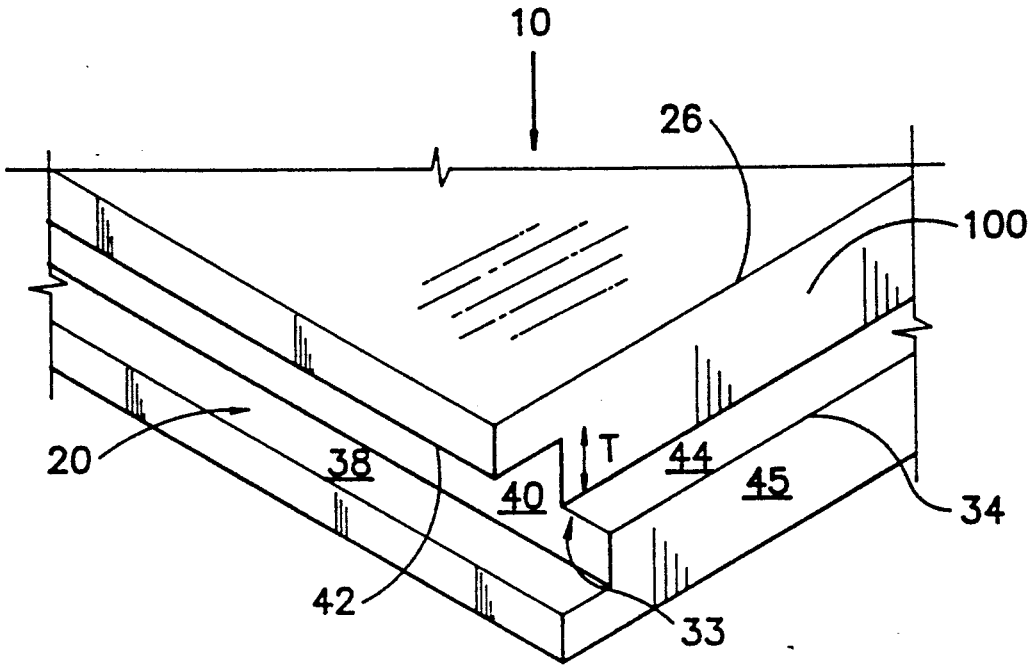
FIG. 5 is a view in perspective illustrating a portion of the terminal block.

FIG. 5 is an enlarged view of the encircled corner region of FIG. 4. The groove 20 is made up of three surfaces, the bottom surface 38, the back surface 40, and the top primary surface 42. The secondary end shoulder 34 has two surfaces, the top surface 44 and side surface 45. The words top, bottom and side are used to refer to the orientation of the surfaces as shown in FIG. 5, and may not necessarily be their orientation in use.

Figure 6:
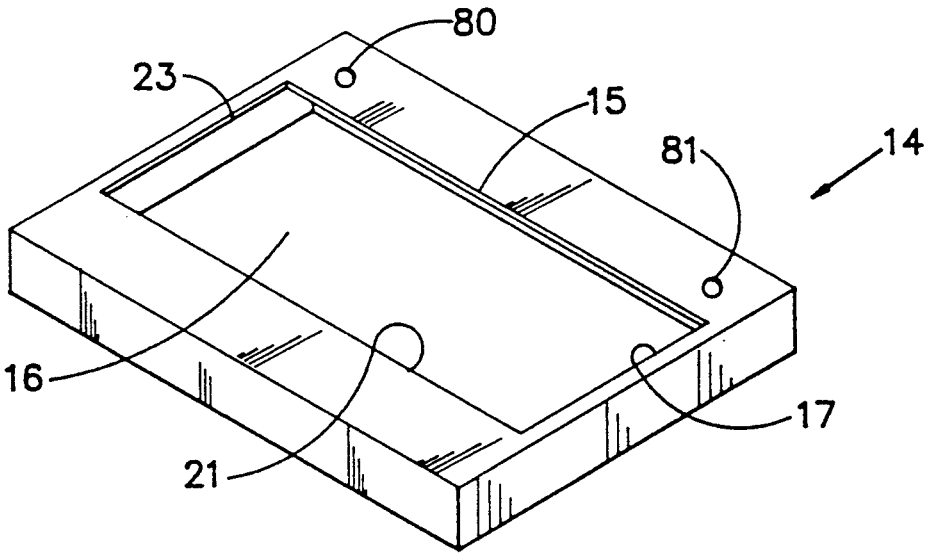
FIG. 6 is a view in perspective illustrating a preferred lid.

In mounting the lid 14 to the terminal block 10, the following steps are undertaken. The terminal block 10 and circuit board 30, as shown in FIG. 4, are placed in close proximity to the lid 14 shown in FIG. 6. Fins 28 are fed through the aperture 16 in the lid 14 until the lid 14 rests as far past the base of the fins 28 as possible. Preferably, the aperture edge 15 rests on top of the ledge formed by the rim 26 on the side opposite the groove 20, and the opposite aperture edge 21 is inserted slightly within the groove 20. In this position, the lid 14 is angled with respect to the plane of the platform 22, since it is supported at edge 15 by the rim 26 and at edge 21 by the bottom surface 38 of the groove 20, two uneven, spaced, noncoplanar surfaces.

The next step in mounting the terminal block 10 to the lid 14 is to slide the aperture edge 21 of the lid 14 deeper into the groove 20, toward the back wall 40. The distance between the back wall 40 of the groove 20 and the surface of the rim 26 parallel to the back wall 40 and on the opposite side of the terminal block 10 is substantially equal to the width of the aperture 16. Therefore, pushing the aperture edge 21 into the groove 20 will result in the opposite aperture edge 15 falling off of the ledge formed by rim 26 on the opposite side of the terminal block 10, when the aperture edge 21 reaches the groove back wall 40. The lid 14 is supported at this time by the platform 22 along one side of the lid 14 and the secondary end shoulders 34 and 35 on the edges 17 and 23 of the lid 14. The top primary surface 42 of the groove 20 supports the edge 21 of the lid 14.

Thus, the terminal block 10 is supported in the panel by a primary shoulder having primary surface 42 facing and seating against one surface of the panel. The secondary shoulders 34 and 35 have surfaces 43 and 44 seating against the opposite surface of the panel. The planes of these surfaces are spaced by approximately the thickness of the panel. The platform 22, if made coplanar with the surfaces of secondary end shoulders 34 and 35, is yet another secondary shoulder. For firm support, only two of the three secondary shoulders are needed, but all three are preferred.

The lid 14 does not contact the bottom surface 38 of the groove 20 when it is in its preferred assembled and mounted position. This creates a gap, visible in FIG. 2. This gap is due to the thickness of the lid 14 being less than the distance between the bottom surface 38 and the top surface 42 of the groove 20. The lid 14 must have a thickness less than the width of the groove 20 so that the aperture edge 21 can extend into the groove 20 on an angle during assembly. The thickness of the lid 14 is substantially equal to the distance between the top, primary surface 42 of the groove 20 and the top, secondary surface 44 of the secondary end shoulder 34. This is noted as the value T in FIG. 5.

As explained above, when the aperture edge 21 is placed against the back wall 40 of the groove 20, the opposite aperture edge 15 falls down onto a surface coplanar with the top surface 44 of the secondary end shoulders 34 and 35. As the edge 15 falls down, the edge 21 of the aperture 16 that is within the groove 20, is driven upward, since the whole lid 14 is pivoting about a fulcrum. This fulcrum is located at the corner 33 formed between the top surface 44 of the end shoulder 34 and the back wall 40.

Therefore, in its preferred mounted position, the aperture edge 17 rests on the top, secondary surface 44, the edge 15 rests on the secondary surface of platform 22 and the edge 21 rests under and against the top primary surface 42. The edge 23 rests similarly to edge 17, but at the end, secondary shoulder 35 on the opposite end of the terminal block 10. Once this position has been reached, the assembled terminal block 10 and circuit board 30 are together inserted into the cabinet 12 and the lid 14 is placed over the open end of the cabinet 12. In this position, the screws 18 and 19 can be placed in holes 80 and 81 formed in the lid 14, visible in FIG. 6, and corresponding holes 83, and another not visible, in the terminal block 10. The screws 18 and 19 are threaded into holes in the tabs 24 and 25, and then tightened, clamping the platform 22 between the lid 14 and the tabs 24 and 25.

The bottom surface 38 of the groove 20 is present in the preferred embodiment since it enhances the blocking of debris from passing between the terminal block 10 and the lid 14. It extends beyond the length of the upper surface 42, out to the sidewall 45. If the bottom surface 38 were shortened, leaving the sidewall 40 to extend downward to the lowest extremity of the terminal block 10, the support of the lid 14 in its mounted position would not differ with respect to the preferred embodiment. The bottom surface 38 exists in the preferred embodiment due to the benefits it provides, but it is understood that upon removing it, the mount could still function as well structurally as in the preferred embodiment.

In FIGS. 4 and 5, the rim 26 has a sidewall 100, and there is a similar sidewall 101 at the opposite end of the terminal block 10. The distance between the sidewalls 100 and 101 is substantially equal to the distance between the edges 17 and 23 of the lid 14 shown in FIG. 6. Therefore, when the lid 14 is mounted in its preferred position, the edges 17 and 23 will butt against the sidewalls 100 and 101, respectively, with sufficient clearance.

As shown in FIGS. 1, 2 and 3, the rim 26 extends around the aperture 16 and protrudes at a higher level beyond the lid 14, creating a difference in distance between the top of the rim 26 and the top of the edges 15, 17, 21 and 23 of the lid 14. This difference is intentional and is for the purpose of preventing the formation of a concavity or crevice where the edges 15, 17, 21 and 23 meet the terminal block 10. Any concavity in this meeting area could allow debris to "puddle" in the concavity and potentially work its way into the cabinet 12. By creating a ledge or step of substantial height, the possibility of slight differences in thickness along the edges of the lid 14, or slight bends of the lid 14 creating a concavity are virtually eliminated. The platform 22, the shoulders 34 and 35, and the bottom surface 38 also prevent debris from entering the cabinet 12.

The rim 26 located at the short sides of the terminal block in the preferred embodiment may not exist on another terminal block having more terminals than shown in FIG. 4. In this case, a sidewall similar to the sidewall 100 would likely extend from what is the top surface 44 of the end shoulder 34 in the preferred embodiment, upward to the top of the fin. The structure would be similar at the opposite end. In this case, puddling would still be prevented since the edge of the lid 14 would still be beneath the adjoining sidewall 100, but the rim 26 would not be formed.

Figure 7:
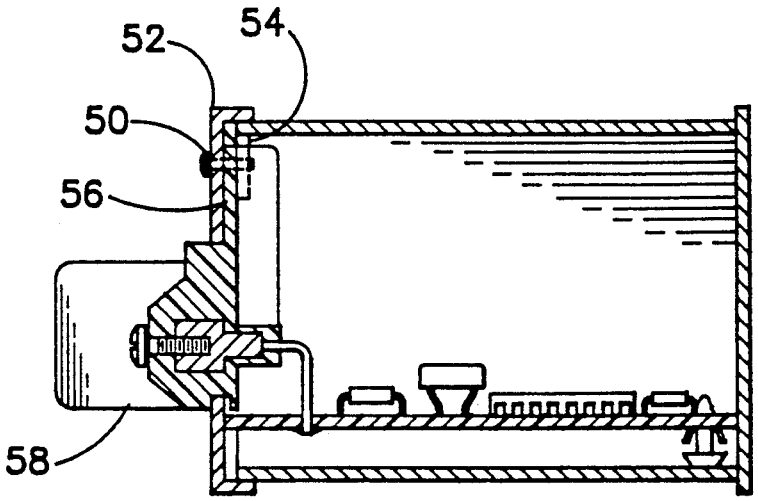
FIG. 7 is a side view in section illustrating an alternative fastener.
Figure 8:
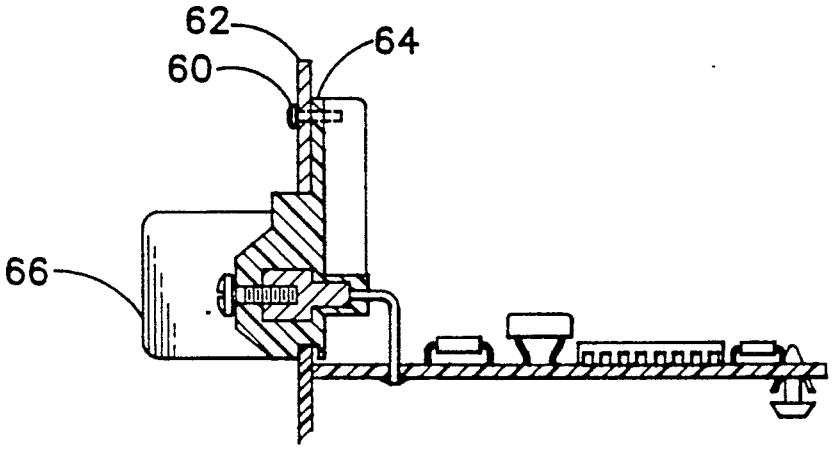
FIG. 8 is a side view in section illustrating another alternative fastener.

Alternative fastening means exist, such as those shown in FIGS. 7 and 8. FIG. 7 shows a screw 50 which is placed through a hole formed in a lid 52 and threaded directly into a tab 54. As the screw 50 is tightened, a platform 56 of a terminal block 58 is clamped between the lid 52 and the tab 54, without the screw 50 being in contact with or placed through a hole in the platform 56. This illustrates that the terminal block 58 need only be held in position by clamping to restrain the motion of the terminal block 58 perpendicular to the lid 52.

The embodiment shown in FIG. 8 shows a screw 60, extended through a panel 62, and threaded directly into a platform 64 of a terminal block 66. This illustrates the ability to mount the terminal block 66 in a panel only, that is, without some enclosing cabinet. Clamping is also not necessary, as long as the block 66 is kept within the aperture of the panel 62. This can be accomplished with a conventional fastening means, such as a screw or rivet attaching the terminal block 66 directly to the panel 62.

The number of fasteners available to perform the task of holding the platform 22 of the terminal block 10 in place is extremely high. A screw threaded through the lid 14 and into the platform 22, as well as a pop rivet or other expanding shaft, or "molly" screw type of fastener is equivalent to those shown. Any fastener which extends through the lid 14, does not contact the platform 22, but clamps the platform 22 between the lid 14 and some other rigid structure should be included as equivalent to the preferred clamping described above. This should include a bolt extending through a hole in the lid 14, and a washer and nut that are seated against the far side of the terminal block. The tightening of the nut will clamp the terminal block between the lid and the nut. Additionally, any spring biased clamping structure should be considered equivalent as well. Fasteners should not be considered equivalent only if they are similar to those mentioned here, but should also include those that are not mentioned, but which perform the same purpose.

Figure 9:
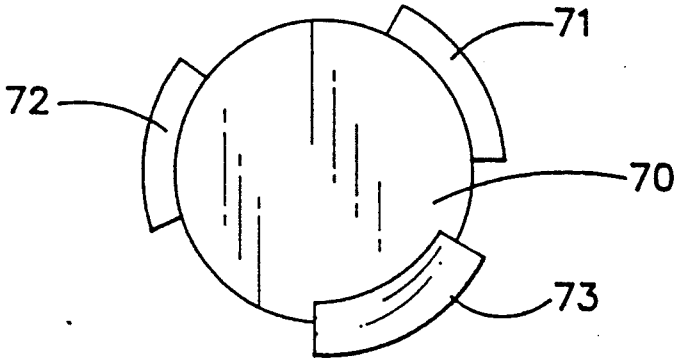
FIG. 9 is a top view illustrating an alternative mounted object.

FIG. 9 shows a circular body 70 having flanges 71, 72, and 73 spaced around its circumferential edges. The flanges 71 and 72 are formed on the back side of the circular body 70 and the flange 73 is formed on the front side of the circular body 70, in the orientation illustrated in FIG. 9. This embodiment shows that a circular object is included in the class of polygons just as more typical polygonal shapes, such as hexagons and rectangles. A circle can be defined as having an infinite number of straight sides, or it can be defined as having curved sides. Either way, a circle is defined as a polygonal object in this application and in the following claims.

While certain preferred embodiments of the present invention have been disclosed in detail, it is to be understood that various modifications may be adopted without departing from the spirit of the invention or scope of the following claims.

I claim:

1. An improved mount for mounting a polygonal object in an aperture formed in a panel having an inner surface and an outer surface which face in opposite directions, the mount comprising:

(a) a primary shoulder formed on one side of the object and having a surface facing and seating against one of the oppositely directed surfaces of the panel;

(b) coplanar secondary shoulders formed on at least two other sides of the object, the secondary shoulders each having a surface facing and seating against the other oppositely directed surface of the panel, the distance between the plane of the surface of the secondary shoulders and the plane of the surface of the primary shoulder being substantially equal to the thickness of the panel; and (c) a fastener for attaching one of the secondary shoulders to the panel.

2. An improved mount in accordance with claim 1 wherein a shoulder, parallel to the primary shoulder, is formed on the side of the object on which the primary shoulder is formed, having an oppositely facing surface spaced from the surface of the primary shoulder, forming a groove between the facing surfaces of the shoulders into which an aperture boundary edge of the panel projects.

3. An improved mount in accordance with claim 2 wherein the distance across the groove, between the oppositely facing surfaces of its shoulders, is greater than the thickness of the panel for permitting the angling of the panel between the oppositely facing surfaces of the groove.

4. An improved mount in accordance with claim 3 wherein the distance between a wall at the deepest region of the groove and an oppositely facing, parallel wall on the opposite side of the object is substantially equal to the distance between a pair of aperture boundary edges facing the two walls.

5. An improved mount in accordance with claim 4 and wherein the polygonal object comprises a rectangular terminal block having one primary shoulder and three secondary shoulders.

6. An improved mount in accordance with claim 4 wherein a ledge, having a sidewall extending from each of the secondary shoulders to a rim, is formed on the mounted object and aperture boundary edges of the panel engage the sidewalls a substantial distance from the rim of the ledge for precluding the formation of a concavity where the panel engages the mounted object.

7. An improved mount in accordance with claim 5 wherein the panel attaches to a mounting body and at least one screw extends through the panel, through the terminal block and threads into the mounting body, clamping the terminal block between the mounting body and the lid.

8. An improved mount in accordance with claim 7 wherein the mounting body comprises a container.

9. An improved mount in accordance with claim 5 wherein the panel attaches to a mounting body and at least one screw extends through the panel and threads into the mounting body, clamping the terminal block between the panel and the mounting body.

10. An improved mount in accordance with claim 5 wherein the fastener comprises at least one screw extending through the panel and threading into the terminal block.

11. An improved mount in accordance with claim 5 wherein the three secondary shoulders and the shoulder on the opposite side of the groove from the primary shoulder are continuously joined around the periphery of the aperture in the panel, forming a continuous, peripheral lip extending outwardly from the aperture to overlap the panel.

12. An improved mount in accordance with claim 1 wherein the polygonal object and the aperture are circular.

* * * * *